United States Patent [19]

Cho

[11] Patent Number: 4,585,730

[45] Date of Patent: Apr. 29, 1986

[54] ANTISTATIC BACKING LAYER WITH AUXILIARY LAYER FOR A SILVER HALIDE ELEMENT

[75] Inventor: Thomas B. Cho, East Brunswick, N.J.

[73] Assignee: E. I. Du Pont de Nemours and Company, Wilmington, Del.

[21] Appl. No.: 697,378

[22] Filed: Jan. 16, 1985

[51] Int. Cl.[4] ..... G03C 1/82

[52] U.S. Cl. ..... 430/527; 430/523; 430/528; 430/529; 430/961

[58] Field of Search ..... 430/527, 528, 529, 523, 430/961

[56] References Cited

U.S. PATENT DOCUMENTS

| | | | |
|---|---|---|---|
| 3,551,152 | 12/1970 | Mackey et al. | 96/85 |
| 3,786,001 | 1/1974 | Van Paesschen et al. | 430/527 |
| 4,225,665 | 9/1980 | Schadt | 430/529 |
| 4,374,924 | 2/1983 | Yokoyama et al. | 430/528 |
| 4,396,708 | 8/1983 | Ogawa et al. | 430/529 |
| 4,407,937 | 10/1983 | Sugimoto et al. | 430/257 |

*Primary Examiner*—Jack P. Brammer

[57] ABSTRACT

As part of a photographic film, a backing layer is coated with an auxiliary layer designed to conduct antistatic properties from an antistatic underlayer to the surface of the backing.

8 Claims, 1 Drawing Figure

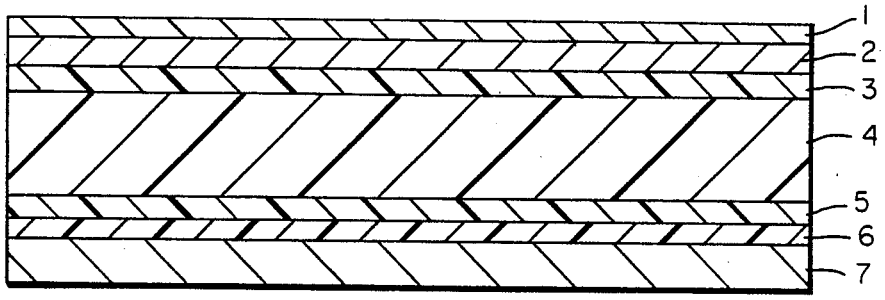
1
2
3
4
5
6
7

ANTISTATIC BACKING LAYER WITH AUXILIARY LAYER FOR A SILVER HALIDE ELEMENT

BACKGROUND OF THE INVENTION

1. Cross-reference to related applications

This application is related to copending application U.S. Ser. No. 691,768, filed Jan. 16, 1985, which is directed to a process for applying a thin, clear antistatic layer to a photographic film. The present invention provides an auxiliary layer designed to be coated over such layer.

2. Field of the Invention

This invention is in the field of photographic film. More particularly, this invention is directed to backing layers for such film which can conduct antistatic properties from an antistatic underlayer to the outside surface the backing.

3. Background Art

Polymeric film supports for photographic film are known for their propensity to accumulate static charges. This is a particular problem where the film is designed to be handled by machine and to be processed rapidly over unlike surfaces. Static charges which may be generated at this time cannot be readily tolerated because discharging these may expose the photographic layer, or layers, coated thereon.

The use of so-called antistatic layers to prevent the build-up of these static charges is well known in the art. Schadt patent, U.S. Pat. No. 4,225,665, describes one such composition comprising a mixture of (1) a water-soluble copolymer of the sodium salt of styrene sulfonic acid and a carboxyl-containing monomer, (2) a hydrophobic polymer containing carboxyl groups, and (3) a water-soluble polyfunctional aziridine. When this mixture is applied as a single layer to resin-subbed (resin-subcoated) poly(ethylene terephthalate), for example, it provides excellent protection from the build-up of static charges (e.g. surface resistivity).

Copending application U.S. Ser. No. 691,768, filed Jan. 16, 1985 describes an improvement over the Schadt patent wherein component (1) is applied to the support in a first coating, optionally a composition containing component (2), and component (3) is applied as a second coating contiguous thereto. This improved process permits the application of thinner layers without premature reaction of the aziridine with the other ingredients. Products from such premature reaction can sometimes plug and foul coating equipment, which is not commercially tolerable.

Nevertheless a problem with prior art antistatic layers generally is that coatings applied thereto tend to mask or cover their antistatic properties. The present invention provides a solution to that problem.

SUMMARY OF THE INVENTION

It is an object of this invention to provide a backing layer which can be coated over antistatic layers and which will conduct antistatic properties thereto. These and other objects are achieved in a photographic film comprising a support, at least one silver halide emulsion coated on one side thereof, and an antistatic layer coated on the opposite side of said support, characterized in that the antistatic layer is coated with an auxiliary layer consisting essentially of a gelatin binder containing a conductive polymer, coated on said antistatic layer at a pH of 5 to 8, whereby the antistatic properties of the antistatic layer are conducted through said auxiliary layer.

DETAILED DESCRIPTION OF THE INVENTION

Conductive polymers useful within the ambit of this invention include anionic polymers such as poly(sodium styrene sulfonate), poly(cellulose sulfate), poly(sodium styrene sulfonate-maleic acid), and poly(sodium styrene butylmethacrylate-butylacrylate-methacrylic acid), among others. Also included are cationic polymers such as poly(dimethyldiallyl ammonium chloride), and poly(styrene sulfonic acid ammonium salt). These polymers may be added to the auxiliary layer of this invention in a range of 0.3 to 10% by weight of the gelatin binder and preferably at 0.5 to 3.0% by weight.

The term "gelatin binder" denotes a binder wherein the major component is gelatin. Gelatin substitutes (e.g. polyvinyl alcohol, dextran, cellulose derivatives, modified gelatins, a water-soluble polymer latex, etc.) may also be present in minor amounts (e.g. less than 17% by weight.

A mixture of the gelatin binder in water, and the conductive polymer, is made up prior to coating. Other additives (e.g. antihalation dyes, surfactants, wetting agents, and hardeners or crosslinking agents for gelatin) may also be present. At this point, just prior to coating, the pH is adjusted to 5.0 to 8.0 (prefer pH of 5.6).

The aqueous coating composition made as described above may be applied with good results to any of the conventional photographic film supports but the preferred support is poly(ethylene terephthalate) subcoated with a layer or layers of conventional resins and containing the antistatic coatings of Miller application U.S. Ser. No. 691,768, filed Jan. 16, 1985. The backing layer of this invention is then coated thereon at a coating weight of about 40 to 100 mg/dm$^2$ and preferably about 55 to 85 mg/dm$^2$.

Referring now specifically to the drawing, which illustrates a photographic film in cross-section, a preferred embodiment will have a dimensionally stable poly(ethylene terephthalate) film support 4 subbed (subcoated) on both sides with conventional resin sub layers 3 and 5. Contiguous to layer 3 is coated a gelatin subcoat followed by a radiation-sensitive, gelatino-silver halide emulsion layer 2. Over layer 2 is coated a hardened gelatin abrasion (protective overcoat) layer. On the opposite side of said support an antistatic layer 6 made according to the teachings of Schadt, U.S. Pat. No. 4,225,665 or Miller application U.S. Ser. No. 691,768, filed Jan. 16, 1985, is applied, followed by the layer 7 of this invention. It is preferred that layer 7 be an antihalation layer since many products used in phototypesetting and the like require such a layer. However, layer 7 may also be a gelatin backing layer conventionally used to "balance" the coatings on the opposite side and prevent curl.

When layer 7 is made as taught in this invention, the antistatic properties of layer 6 are conducted through layer 7 to the surface thereof and maintained therein. This is not possible without the teachings of this invention, and antistatic properties are diminished, even completely lost, when a backing layer without the conductive polymer and coated at a pH range outside of this invention is applied in place of the one described above.

A host of conventional photosensitive materials may be substituted for layer 3 described above. These include photopolymer, diazo, vesicular image-forming materials, etc. The film described may be used in any of the well-known imaging fields such as graphic arts, printing, medical and information systems, among others. The photographic film of this invention is particularly useful in processes where rapid transport and handling by machines are practiced, such as phototypesetting applications, for example.

This invention will now be illustrated by the following examples of which Example 3 is considered to be the best mode:

EXAMPLE 1

A backing layer solution was prepared by mixing 1200 g of gelatin in 13,530 g of distilled water for 15 minutes at 125° C. The mixture was cooled to 90° C. and the following ingredients added:

| Ingredient | Amt. (g) |
|---|---|
| 4.2% aqueous solution of sodium octyl phenoxy diether sulfonate wetting agent (Triton ® X200, Rohm & Haas Co.) | 498 cc |
| ethyl alcohol | 450 |
| distilled water | 1050 |
| SF Yellow Dye(1) | 108 |
| S-1240 Dye(2) | 50 |
| Acid Violet Dye(3) | 54 |
| Polyethyl Acrylate Latex | 750 |
| 6% aqueous solution of sodium myristyl triether sulfate wetting agent (Standapol ® ES40, Henkel Inc., U.S.A.) | 52 |
| Sulfuric Acid (3N) | 65 |
| 10% aqueous solution of sodium N—coco-β-amino propionate wetting agent (Deriphat ® 151, Henkel Inc., U.S.A.) | 42 |
| Silica Matte (12 mμ, Davidson Chem. Co.) | 5.3 |

(1)SF Yellow (D782)

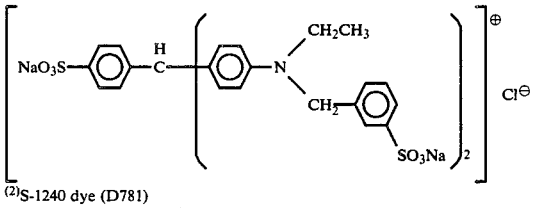

(2)S-1240 dye (D781)

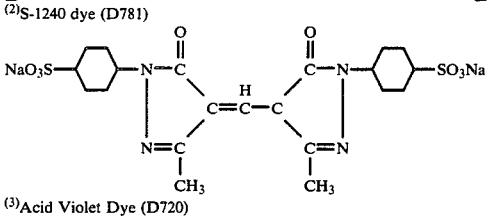

(3)Acid Violet Dye (D720)

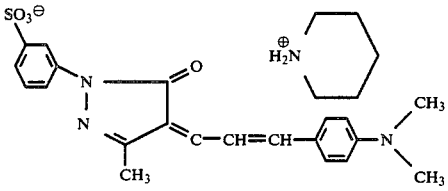

These ingredients were thoroughly mixed and split into portions of about 1788 g of each. Five portions were used for this example with further additions and treatments as follows:

| Sample | pH | Amt. Cond. Polymer(1) Added (%) | $Na_2SO_4$ (%) |
|---|---|---|---|
| 1-Control | 5.0 | none | none |
| 2 | 5.0 | 10 | none |
| 3 | 5.6 | 0.5 | none |
| 4 | 6.2 | 0.5 | none |
| 5-Control | 5.0 | none | 0.1 |

(1)poly(styrene sodium sulfonate), Versa TL-500 ®) Natl. Starch & Chem. Co., Bridgewater, NJ To test the efficacy of these materials, a sample of poly(ethylene terephthalate) film (4 mil), resin-subbed on both sides, was coated with an antistatic layer comprising an aqueous solution containing a copolymer of the sodium salt of styrene sulfonic acid with maleic acid (M.W. ca. 5,000) in a 3:1 mole ratio, and a terpolymer binder, i.e., poly(styrene:butylmethacrylate:butylacrylate:methacrylic acid), 45:43:8:3, followed by an aqueous coating of a trifunctional aziridine (e.g. pentaerythritol-tri-[62-)N aziridinyl)-propionate] to give a 4 mg. coating with a ratio of 66/34/10 parts respectively of the copolymer:terpolymer:aziridine, respectively. The coatings were dried in between application of the copolymer and terpolymer and the aziridine and then heat relaxed to produce a dimensionally stable poly(ethylene terephthalate) film support having an effective antistatic layer applied over a resin sub layer.

Five strips of this film were taken and the above sample coated thereon at 85 mg/dm$^2$ coating weight to provide the support with a typical antihalation layer. The surface resistivities were then measured. Details of the measurements of surface resistivities for photographic films may be found in Nadeau et al, U.S. Pat. No. 2,801,191. Amey et al, American Society for Testing Materials Proceedings, Vol. 49, 1079–1091 (1949) provide the details for the surface resistivity measurements of this application. While surface resistivity was used extensively in evaluating the present invention, a dynamic measure was also made by electronically counting the static discharges as film samples were transported through an apparatus simulating a microfilm camera containing rollers known for high levels of static generation. Both static and dynamic tests were run under controlled humidity conditions, since otherwise the test results would not be comparable due to the variation in static propensity with changes in humidity. The following results were obtained:

| Sample | Resistivity (Ω/□) |
|---|---|
| 1-Control | $>1 \times 10^{18}$ |
| 2 | $3.8 \times 10^{12}$ |
| 3 | $3.5 \times 10^{11}$ |
| 4 | $2.2 \times 10^{11}$ |
| 5-Control | $>1 \times 10^{18}$ |

In this test, the lower the number the better the static protection achieved. As can be seen from this example, high resistivity, and thus poor static protection, was achieved in the controls (e.g. when only the pH was adjusted or when a charge carrier such as sodium sulfate was added) while low resistivity (good static protection) was achieved by the practice of this invention (Samples 2, 3 and 4).

EXAMPLE 2

Four more portions of the mixture of Example 1 were taken and the following additions and adjustments made:

| Sample | pH | Amt. Cond. Polymer Added (%) - See Ex. 1 |
|---|---|---|
| 1 | 5.6 | 1.5 |
| 2 | 5.6 | 5.0 |
| 3 | 6.2 | 1.5 |
| 4 | 6.2 | 5.8 |

These samples were then coated on strips of film prepared as described in Example 1 and the resistivities measured as described therein with the following results:

| Sample | Resistivity |
|---|---|
| 1 | $4.9 \times 10^{11}$ |
| 2 | $3.5 \times 10^{11}$ |
| 3 | $3.4 \times 10^{11}$ |
| 4 | $1.5 \times 10^{11}$ |

All of these elements had excellent resistance to static build-up.

EXAMPLE 3

In order to test the efficacy of other conductive polymers (both anionic and cationic) portions of the mixture prepared in Example 1 were taken and 12 g of the below listed conductive polymers added thereto:

poly(cellulose sulfate)
poly(sodium styrene sulfonate-maleic acid)
poly(sodium styrene butylmethacrylate:butylacrylate:methacrylic acid)
poly(dimethyldiallyl ammonia chloride)
poly(styrene sulfonic acid ammonium salt)

The pH was adjusted to 5.6 and then were coated on antistatic film elements as described in Example 1. All samples had good static protection, indicating that these conductive polymers transmitted the static protection as described above.

EXAMPLE 4

A photographic element was prepared, employing a film support prepared as described in Example 1 having a resin subcoat on both sides and an antistatic layer applied on one side thereof. A gelatin layer was then applied on the other resin subcoat, followed by a photographic gelatino-silver halide emulsion of ca. 92% Br and ca. 8% Cl and having been brought to its optimum sensitivity with gold and sulfur as is well-known in the art.

A sensitizing dye, 5-[(3-ethyl-2H,3H-2-benzothiazolylidene)isopropylidene]-2-thiohetooxazolidine-4-one (120 cc of a 1% alcoholic solution per 1.5 moles of silver halide) was also added to increase the spectral sensitivity of this emulsion. Conventional wetting agents, antifoggants, hardeners, and coating aids were also added.

This emulsion was coated to ca. 100 mg/dm$^2$, and a hardened gelatin abrasion layer applied thereover. An antihalation layer made according to Example 1, Sample 3 was then coated over the antistatic layer and dried. The final product, then, had the structure of the drawing described above.

This film was tested thoroughly by passing through a typical phototypesetting process without any problem due to static. Another element prepared in the same manner but coated at a lower pH (4.9) and without the conductive polymer, had a number of static discharges which prematurely exposed the silver halide element.

I claim:

1. A photographic film comprising a support, a silver halide emulsion layer on one side of said support, and an antistatic layer on the opposite side of said support, characterized in that the antistatic layer is coated with an auxiliary layer consisting essentially of a gelatin binder containing a conductive polymer in a concentration range of 0.3 to 10% by weight of the gelatin binder taken from the group consisting of poly(sodium styrene sulfonate), poly(cellulose sulfate), poly(dimethyl diallyl ammonium chloride), poly(sodium styrene sulfonate-maleic acid); poly(sodium styrene butyl methacrylate-butylacrylate-methacrylic acid) and poly(styrene sulfonic acid ammonium salt), coated on said antistatic layer at a pH of 5–8, whereby the antistatic properties of the antistatic layer are conducted through said auxiliary layer.

2. The photographic film of claim 1 wherein the conductive polymer is a poly(sodium styrene sulfonate).

3. The photographic film of claim 1 wherein the conductive polymer is a poly(cellulose sulfate).

4. The photographic film of claim 1 wherein the conductive polymer is a poly(dimethyl diallyl) ammonium chloride).

5. The photographic film of claim 4 wherein the conductive polymer is a poly(sodium styrene sulfonate-maleic acid).

6. The photographic film of claim 1 wherein the conductive polymer is a poly(sodium styrene butylmethacrylate-butylacrylate-methacrylic acid).

7. The photographic film of claim 1 wherein the silver halide emulsion layer is covered with a protective overcoat layer.

8. The photographic film of claim 1 wherein the auxiliary layer also contains a crosslinking agent for the binder.

* * * * *

UNITED STATES PATENT AND TRADEMARK OFFICE

CERTIFICATE OF CORRECTION

PATENT NO. : 4,585,730

DATED : April 29, 1986

INVENTOR(S) : Thomas B. Cho

It is certified that error appears in the above-identified patent and that said Letters Patent is hereby corrected as shown below:

| Column | Line | |
|---|---|---|
| 6 | 42 | "diallyl)" should be --diallyl ammonium-- |
| 6 | 44 | "4" should be --1-- |

Signed and Sealed this

Seventh Day of October, 1986

[SEAL]

*Attest:*

DONALD J. QUIGG

*Attesting Officer*

*Commissioner of Patents and Trademarks*